US008276522B2

(12) United States Patent
Simson

(10) Patent No.: US 8,276,522 B2
(45) Date of Patent: Oct. 2, 2012

(54) STEERING RAILWAY BOGIE

(75) Inventor: Scott Simson, Rockhampton (AU)

(73) Assignee: Central Queensland University, Rockhampton, Queensland (AU)

( * ) Notice: Subject to any disclaimer, the term of this patent is extended or adjusted under 35 U.S.C. 154(b) by 300 days.

(21) Appl. No.: 12/527,899

(22) PCT Filed: Feb. 21, 2008

(86) PCT No.: PCT/AU2008/000225

§ 371 (c)(1),
(2), (4) Date: Nov. 12, 2009

(87) PCT Pub. No.: WO2008/101287

PCT Pub. Date: Aug. 28, 2008

(65) Prior Publication Data

US 2010/0326317 A1 Dec. 30, 2010

(30) Foreign Application Priority Data

Feb. 22, 2007 (AU) ..... 2007900891

(51) Int. Cl.
*B61F 5/38* (2006.01)

(52) U.S. Cl. ..... 105/168; 701/19; 701/41; 105/166

(58) Field of Classification Search ..... 105/199.1, 105/199.2, 3, 4.4, 165, 166, 167, 168, 176, 105/182.1; 701/19, 41; 702/33
See application file for complete search history.

(56) References Cited

U.S. PATENT DOCUMENTS

| | | | | |
|---|---|---|---|---|
| 424,089 | A * | 3/1890 | Bosdevex | 105/168 |
| 4,289,075 | A | 9/1981 | Smith | |
| 5,000,097 | A | 3/1991 | List | |
| 5,438,933 | A * | 8/1995 | Lipsius et al. | 105/168 |
| 5,613,444 | A * | 3/1997 | Ahmadian et al. | 105/166 |
| 6,161,064 | A | 12/2000 | Strasser et al. | |
| 6,871,598 | B2 * | 3/2005 | Schaller et al. | 105/168 |
| 2005/0103223 | A1 * | 5/2005 | Schneider et al. | 105/168 |

FOREIGN PATENT DOCUMENTS

| | | |
|---|---|---|
| EP | 655378 | 2/2000 |
| EP | 1193154 | 4/2002 |
| EP | 1116637 | 12/2004 |
| JP | 11245810 | 9/1999 |

* cited by examiner

*Primary Examiner* — Mark Le
(74) *Attorney, Agent, or Firm* — Shoemaker and Mattare

(57) ABSTRACT

A bogie for a railway vehicle includes a frame, a plurality of wheelsets, and steering linkages linking the wheelsets to maintain steering alignment. The bogie has a wheelset body linkage pivotally connecting the steering linkages with the bogie body so as to position the body relative to the wheelsets, and two alignment rams to position the body relative to the frame. The bogie also has sensors for monitoring yaw angle and yaw velocity. The sensor input is processed to estimate track curvature and determine the train speed and yaw velocity of the vehicle body. The processor actuates the alignment rams to adjust the position of the body relative to the frame in response to the track curvature and current frame positions to minimize wheel contact creepage and maximize bogie stability.

7 Claims, 4 Drawing Sheets

STEERING RAILWAY BOGIE

FIELD OF INVENTION

The present invention relates to railways and railway bogies.

BACKGROUND OF THE INVENTION

A steering railway bogie includes a frame and two or more wheelsets connected to the frame. The frame is connected to a railway vehicle body. Each wheelset comprises two spaced apart wheels operatively linked by an axle. The wheelsets have freedom of movement to yaw relative to other wheelsets of the bogie so as to give an angle of steering.

Each wheel often has a flange for safety but they rarely make contact with the rail. The tread of each wheel is slightly tapered having a non linear conical profile. The purpose of steering bogies is to minimise creep forces other than traction creep forces at the wheel rail contacts and to evenly distribute the lateral curving forces between each wheelset to minimise wheel, rail and track damage.

When a steering bogie encounters a bend, the wheelsets displace laterally on the rail so that the outer wheel has a higher contact angle to the rail relative to the inner wheel causing the normal contact force of the wheelset on the rail to have a lateral component to the cross level of the rails. If the wheels of the wheelsets have dependent rotation there will also be longitudinal creepage differences between the wheels due to differences in rolling radius that generate a net yaw moment on the wheelset from creepage forces. Further to this a steering bogie wheelsets will displace relative to each other to produce a steering angle and the bogie frame will displace in yaw rotation to maintain tangential alignment of the bogie to the track. In constant curvature track, the steering angles between wheelsets and the yaw rotation angle for the bogie which produce radial alignment of the wheelsets, are a fixed ratio.

Previous steering bogie designs such as yaw relaxation, self steering, force steering, articulated steering and actuated wheelset yaw did not control the yaw rotation of the bogie but were reliant on creep force to correct the bogie yaw. Under traction with low friction to adhesion ratios such bogies are unable to control the bogie yaw.

Passive steering bogies such as yaw relaxation and self steering are fully reliant on creep forces to actuate the steering of axles and under high traction forces revert to straight alignment. Force steering and articulated steering bogies are partially reliant on creep forces for actuation and suffer partial steering lose under high tractions.

Actuated wheelset yaw bogie designs require sensor inputs and control which are independent of the wheel rail creep forces, to control the steering angle of the wheelsets under traction with low friction to adhesion levels. Actuated wheelset yaw bogie designs require the placement of yaw actuators and sensors on the bogie frame or across the bogies primary suspension. These locations are subject to higher impact loads during train operations than is experienced at or above the secondary suspension requiring more robust equipment.

OBJECT OF THE INVENTION

It is an object of the present invention to provide an alternative steering bogie having an active bogie yaw control system and forced radial steering of wheelsets from the bogie yaw position that overcomes at least in part one or more of the abovementioned disadvantages.

SUMMARY OF THE INVENTION

In one aspect the present invention broadly resides in a railway bogie with a mounted vehicle body including a frame;

a plurality of wheelsets mounted to the frame, each of the wheelsets has an axle with two spaced apart wheels;

steering linkage means linking the wheelsets so that the wheelsets can cooperate to be in steering alignment;

wheelset body linkage means for positioning the body relative to the wheelsets alignment means for positioning the body relative to the frame;

sensor means including sensors for monitoring the yaw angle and yaw velocity;

processor means for processing sensor means input to estimate track curvature and determine the train speed and yaw velocity of the vehicle body and thereby actuating the alignment means, wherein the position of the body relative to the frame is adjusted in response to the track curvature and current frame positions to minimize wheel contact creepage and maximize bogie stability.

The frame is preferably adjusted in response to known or estimated track curvature.

The alignment means preferably includes one or more rams, each of which are attached to the frame and the body. Preferably the alignment means includes two rams attached to opposing longitudinal sides of the frame and body and operatively cooperate to position the body with respect to the frame with actuation from the processor means. More preferably when the bogie travels a bend, the inner ram is shortened while the outer ram is lengthened to align the body with the frame to negotiate the bend with minimal yaw moment.

The rams may be hydraulically or pneumatically operated. Actuation of the rams may be by electrical or electromagnetic operation.

Preferably the steering linkage means adjusts the position of one or more of the wheelsets with the positional orientation to be radial to a track curve matching the current relative yaw position of the frame to the body. The steering linkage means preferably includes one or more linkage arm associated with each wheelset. The linkage arms are preferably pivotally attached to each other so that the wheelsets can adopt a radial steering alignment when negotiating a curved track. Each of the linkage arms is preferably attached to both end portions of the respective wheelset and pivotally attached to an adjacent linkage arm associated with an adjacent wheelset; wherein the turning of one wheelset affects the position of the other wheelsets through movement of the linkage arms to allow the wheelsets to radially align with a track curve matching the current relative yaw position of the frame to the body.

The wheelset body linkage means is preferably a linkage support pivotally connected to one of the steering linkage arms and the bogie body. The linkage support is preferably pivotally connected so that changes to the position of the wheelsets and linkage arms changes the relative position of the bogie body.

The front and rear wheelsets preferably pivot about a vertical axis. More preferably the front and rear wheelsets preferably pivot about a vertical axis via coupled linkage arms so that the orientation of one wheelset is substantially opposite to the orientation of the other wheelset with respect to a longitudinal axis of the frame when the bogie is traveling around a bend.

Where there is a third intermediate wheelset, the intermediate wheelset preferably moves transversely with respect to a longitudinal axis of the frame and in line with the longitudinal axis of the wheelset. The intermediate wheelset preferably moves via two linkage arms attached to either side of the wheelset. Each of intermediate wheelset linkage arms are preferably pivotally connected to adjacent linkage arms that are respectively attached to the front and rear wheelsets. The intermediate wheelset preferably moves transversely outwards from the radial centre of the bend that the bogie is traveling around.

The processor means includes a processor that processes the input in accordance with programming relevant to the bogie type. The programming may include information about the known track curvature. Alternately or in conjunction an estimate of the track curvature is preferably made from measuring the train speed and yaw velocity of the vehicle body. The information is preferably used by the processor to set a response for each bogie as the vehicle travels the bend.

A railway bogie a mounted vehicle body including a frame, a plurality of wheelsets mounted to the frame wherein each of the wheelsets has an axle with two spaced apart wheels, steering linkages linking the wheelsets so that the wheelsets can cooperate to be in steering alignment, a wheelset body linkage pivotally connecting the steering linkages with the bogie body so to position the body relative to the wheelsets, two alignment rams to position the body relative to the frame, one or more sensors including sensors for monitoring the yaw angle and yaw velocity, a processor to process the sensor input to estimate track curvature and determine the train speed and yaw velocity of the vehicle body and then actuate the alignment rams to adjust the position of the body relative to the frame in response to the track curvature and current frame positions to minimize wheel contact creepage and maximize bogie stability.

BRIEF DESCRIPTION OF THE DRAWINGS

In order that the present invention can be more readily understood and put into practical effect, reference will now be made to the accompanying drawings wherein.

DETAILED DESCRIPTION OF THE PREFERRED EMBODIMENTS

Figure 1:
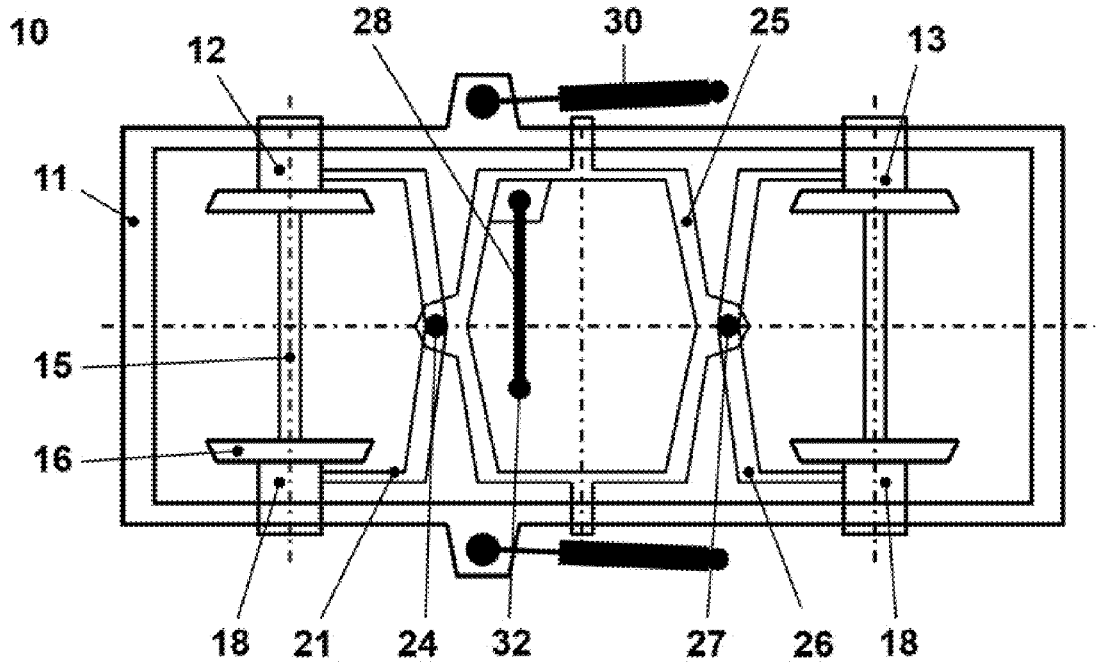
FIG. 1 is a diagrammatic view of a two axle bogie of the first preferred embodiment.
Figure 2:
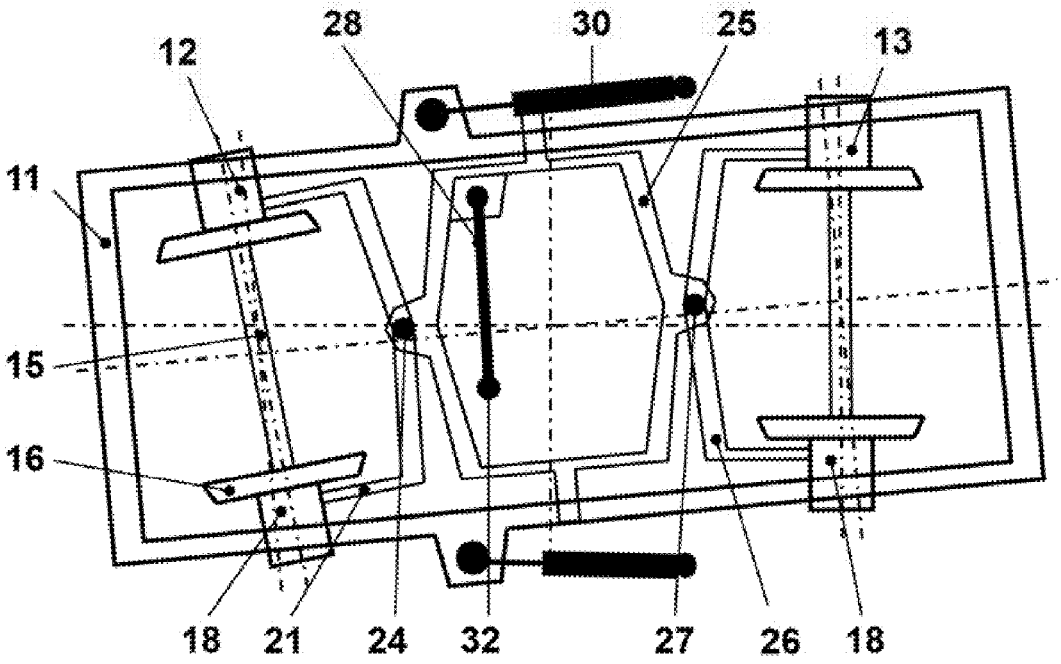
FIG. 2 is another diagrammatic view of a two axle bogie of the first preferred embodiment.

With reference to FIGS. 1 and 2, there is shown a first preferred embodiment of a two axle bogie 10 having a frame 11 with a front wheelset 12 and rear wheelset 13. The bogie 10 also has a vehicle body (not shown) attached to the frame 11.

The front wheelset 12 and rear wheelset 13 include axle 15, tapered wheels 16 and wheelset bearings 18.

The front wheelset 12 has a first linkage arm 21 attached adjacent each end of the axle 15. The first linkage arm 21 is pivotally connected by pivot 24 to a second linkage arm 25. The second linkage arm 25 is substantially rectangular and is also pivotally connected to a third linkage arm 26 at pivot 27. The third linkage arm 26 is attached adjacent each end of axle 15 of rear wheelset 13. The second linkage arm 25 is connected to by body linkage 28 to the vehicle body. In this way the front and rear wheelsets 12, 13 are coupled so that the orientation of the front wheelset 12 affects the orientation of the rear wheelset 13 in a manner that they cooperate to allow the bogie 10 to travel around a bend. With body linkage 28 the front and rear wheelsets 12, 13 and frame 11 are coupled to the vehicle body, so the position of the vehicle body to the frame position adjusts by force the wheelset orientations to match radial alignment to a track curve.

When the bogie 10 moves around a bend, the wheelsets 12,13 follow the track so that the wheels 16 of the wheelsets 12, 13 contacts the rails at substantially the same position on each wheel 16. As the front wheelset 12 follows the track the first linkage 21 causes the second linkage arm 25 to pivot which in turn causes the third linkage arm 26 to pivot and orientate the rear wheelset 13 in a position that is substantially opposite to the orientation of the first wheelset 12 with respect to the longitudinal axis of the frame 11. The second linkage arm 25 deflects transversely because of the connection to body linkage 28 when the front wheelset 12 follows the track around a bend.

The bogie 10 also has alignment rams 30 pivotally attached to the frame 11 at mounting 31. The alignment rams 30 are positioned longitudinally on opposing sides of the frame 11. The alignment rams 30 are also attached to the vehicle body at a position partway up an upright wall on either side of the vehicle body. The alignment rams 30 are pneumatically, hydraulically or electrically operated in response to processed input.

When the bogie 10 travels around a bend of known or estimated track curvature, the processor processes the input in accordance with its programming and actuates the alignment rams 30 so that the opposing alignment rams 30 cooperate to reduce the creep forces on the wheels 16. When the bogie 10 moves around a bend, the inner alignment ram 30 shortens and the outer alignment ram 30 lengthens where inner and outer are with respect to the radial centre of the bend. With actuation of the alignment rams 30, the vehicle body is positioned to be more in line with the frame 11 as it moves around the bend thereby minimizing yaw misalignment of the wheels 16 to the rail minimizing reducing the creepage of the wheels 16 on the rail maximizing the available traction adhesion reducing wheel wear, rolling contact fatigue, flange contact and wheel slip.

The alignment rams 30 of a bogie 10 is actuated in response to the input of the train speed and yaw velocity of the vehicle body estimating curvature of the track. The alignment rams 30 react to the estimate of track curvature. Operating the alignment rams 30 in this mode is a semi-active control method.

Alternatively, the alignment rams 30 may be actuated from input of train position and track database of curvature or known track curvature, where the centrifugal force and deflection difference experienced by the two or more bogie frames 10, or track transponder and velocity or GPS input is processed with a track curvature database. The alignment rams 30 react to the calculated misalignment of the bogie 10 to the known track curvature. This mode of operation is a full active control method and can be used to control anticipated bogie 10 behaviour moving around a bend.

Figure 3:
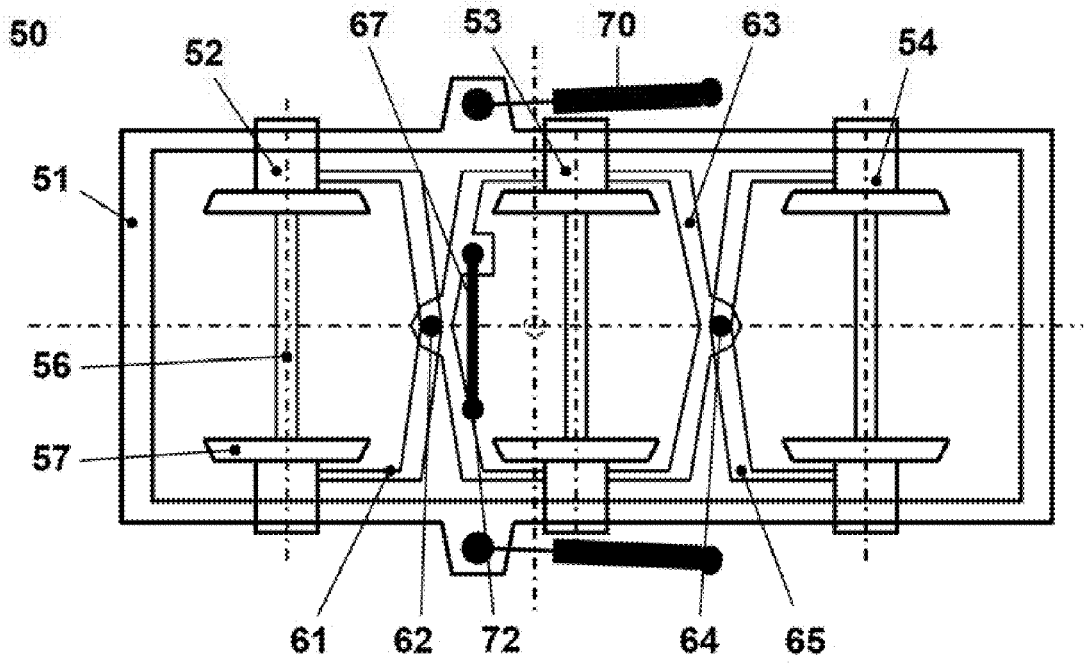
FIG. 3 is a diagrammatic view of a three axle bogie of the second preferred embodiment.
Figure 4:
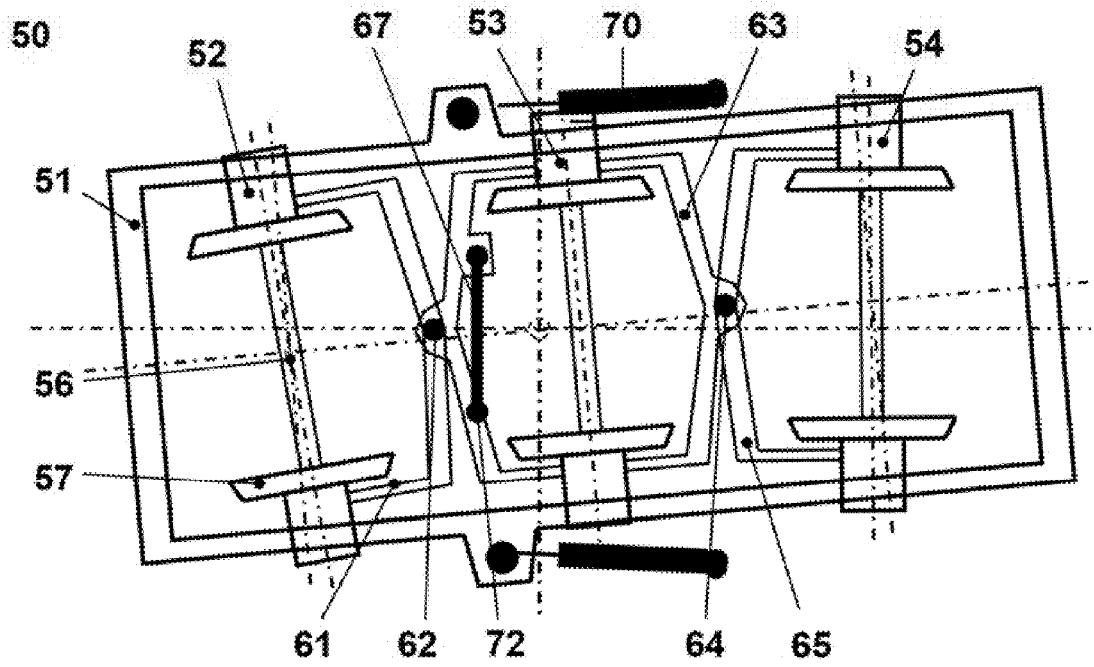
FIG. 4 is another diagrammatic view of a three axle bogie of the second preferred embodiment.

With reference to FIGS. 3 and 4, there is shown a second embodiment of the invention being a three axle bogie 50. Bogie 50 has front wheelset 51, intermediate wheelset 52 and rear wheelset 53. Bogie 50 also has a frame 54 and a vehicle body (not shown).

The wheelsets 51, 52, 53 have axles 56, tapered wheels 57, wheelset bearings 58. The front wheelset 51 has a first linkage arm 61 connected by pivot 62 to a second linkage arm 63. The second linkage arm 63 is attached to the intermediate wheelset 52. The second linkage arm 63 is connected by pivot 64 with the third linkage arm 65. The third linkage arm 65 is attached to rear wheelset 53.

When the first wheelset 51 follows the track the linkage arms 61, 63, 65 orientate the intermediate wheelset 52 and rear wheelset 53 to cooperate with the first wheelset 51 to move around the bend. The intermediate wheelset 52 can move transversely with respect to the longitudinal axis of the frame 54. The intermediate wheelset 52 is held with bushes to the frame 54 allowing the intermediate wheelset 52 to move transversely and in line with its axle 56. Where the bogie 50 is moving around the bend, the intermediate wheelset 52 is repositioned transversely outwards with respect to the radial centre of the bend. The rear wheelset 53 is orientated in the substantially opposite position to the front wheelset 51 as the bogie 50 moves around the bend. The second linkage arm 63 is connected by body linkage 67 to the vehicle body.

The bogie 50 also has alignment rams 70 on opposing longitudinal sides of the frame 54. The alignment rams 70 are connected to the frame mounting 71 and to the vehicle body. The alignment rams 70 operate in substantially the same manner as described for the two axle bogie 10.

Variations

It will of course be realised that while the foregoing has been given by way of illustrative example of this invention, all such and other modifications and variations thereto as would be apparent to persons skilled in the art are deemed to fall within the broad scope and ambit of this invention as is herein set forth.

Variations to the manner of forcing the radial position of wheelsets based on the bogie yaw position relative to the vehicle body including actuation of the wheelsets are in the ambit of this invention. For example an alternative to the mechanical links of the wheelsets is to use ram type actuators which may operate in response to processed transducer input to force radial alignment of the wheelsets.

Throughout the description and claims this specification the word "comprise" and variations of that word such as "comprises" and "comprising", are not intended to exclude other additives, components, integers or steps.

The invention claimed is:

1. A railway bogie with a mounted vehicle body, said railway bogie comprising a frame, a plurality of wheelsets mounted to the frame, wherein each of the wheelsets has an axle with two spaced apart wheels, steering linkages pivotally linking the wheelsets, to provide cooperation between the wheelsets and maintain steering alignment, the plurality of wheelsets comprises a front wheelset and a rear wheelset, wherein the front and rear wheelsets can be pivoted about respective vertical axes by the steering linkage so that orientation of the front wheelset is substantially opposite to orientation of the rear wheelset with respect to a longitudinal axis of the frame when the bogie is traveling around a bend, a wheelset body linkage pivotally connecting the steering linkages with the vehicle body to position the vehicle body relative to the wheelsets, two alignment rams attached to opposing longitudinal sides of the frame and vehicle body and operatively cooperate to position the vehicle body with respect to the frame, one or more sensors including sensors for monitoring yaw angle and yaw velocity, a processor to process the sensor input to estimate track curvature and determine train speed and the yaw velocity of the vehicle body and then actuate the alignment rams to adjust position of the vehicle body relative to the frame in response to the track curvature and current frame positions to minimize wheel contact creepage and maximize bogie stability.

2. A railway bogie as claimed in claim 1 wherein the two alignment rams comprise an inner ram and an outer ram whereby, when the bogie travels a bend, the inner ram can be shortened while the outer ram is lengthened to align the vehicle body with the frame to negotiate the bend with minimal yaw moment.

3. A railway bogie as claimed in claim 1, wherein the steering linkages adjusts position of one or more of the wheelsets to be radial to a track curve matching current relative yaw position of the frame to the vehicle body, and the steering linkage includes one or more linkage arms associated with each wheelset, each of the linkage arms being pivotally attached to each other so that the wheelsets can adopt a radial steering alignment when negotiating a curved track.

4. A railway bogie as claimed in claim 1, wherein the steering linkages includes one or more linkage arms associated with each wheel set, and the wheelset body linkage is a linkage support pivotally connected to one of the steering linkage arms and the vehicle body so that changes to position of the wheelsets and linkage arms changes relative position of the vehicle body.

5. A railway bogie as claimed in claim 1, wherein the steering linkages includes a first linkage arm pivotally connected to a substantially rectangular second linkage arm, and the second linkage arm is pivotally connected to a third linkage arm, the first linkage arm being attached to the front wheelset and the third linkage arm is connected to the rear wheelset.

6. A railway bogie as claimed in claim 1, wherein there is an intermediate wheelset that moves transversely with respect to a longitudinal axis of the frame and moves transversely outwards from a radial center of the bend around which the bogie is traveling.

7. A railway bogie as claimed in claim 1, wherein the processor processes the sensor input in accordance with programming relevant to the bogie type, the programming including information about known track curvature and/or a procedure for estimating track curvature from measurements of the train speed and the yaw velocity of the vehicle body, and actuates the alignment rams to adjust position of the vehicle body relative to the frame in response to the track curvature and current frame positions to minimize wheel contact creepage and maximize bogie stability.

* * * * *